US006089152A

United States Patent [19]

Uchiyama

[11] Patent Number: 6,089,152

[45] Date of Patent: Jul. 18, 2000

[54] STENCIL PRINTING METHOD AND STENCIL PRINTING MACHINE

[75] Inventor: Koichi Uchiyama, Ibaraki-ken, Japan

[73] Assignee: Riso Kagaku Corporation, Tokyo, Japan

[21] Appl. No.: 09/114,272

[22] Filed: Jul. 13, 1998

[30] Foreign Application Priority Data

Jul. 23, 1997 [JP] Japan ..... 9-197335

[51] Int. Cl.[7] ..... B41M 1/12

[52] U.S. Cl. ..... 101/129; 101/125

[58] Field of Search ..... 101/114, 116, 101/119, 120, 123, 124, 112, 125, 129

[56] References Cited

U.S. PATENT DOCUMENTS 3,926,112 12/1975 Neman .

4,043,013 8/1977 Zeppernick ..... 101/148

OTHER PUBLICATIONS

Patent Abstracts of Japan, vol. 018, No. 317 (M–1622), Jun. 16, 1994 & JP06 072002 A (Deyupuro Seiko KK), Mar. 15, 1994.

*Primary Examiner*—Ren Yan
*Attorney, Agent, or Firm*—Kanesaka & Takeuchi

[57] ABSTRACT

In a stencil printing method, an image on a printing material is formed by forcing ink to pass through perforations formed in a stencil sheet and to transfer onto the printing material. The method includes preparing ink transfer device having a surface made of an elastically deformable material; applying ink on the surface of the ink transfer device; and pressing the surface of the ink transfer device against the stencil sheet. Thus, a part of the ink transfer device having the ink deforms to enter into the perforations, thereby transferring the ink onto the printing material through the perforations of the stencil sheet to conduct printing on the printing material.

13 Claims, 8 Drawing Sheets

STENCIL PRINTING METHOD AND STENCIL PRINTING MACHINE

BACKGROUND OF THE INVENTION

The present invention relates to a stencil printing method including the steps of applying ink on one surface of a stencil sheet having perforations therein, disposing a sheet or material to be printed on the other surface of the stencil sheet, and transferring ink onto the sheet by forcing ink to pass through the perforations; and, further to a stencil printing machine for use in the method.

In case where a desired image is formed by using a stencil sheet, a conventional printing method is adopted, which includes the steps of applying ink such as emulsion ink on one surface of a stencil sheet with perforations, disposing a printing sheet on the other surface of the stencil sheet, and transferring the ink onto the printing sheet by exerting pressure on the one surface to force the ink to pass through the perforations, thereby completing printing.

In the printing operation described above, the pressure for transferring ink is applied on the surface by using methods such as a flat press method and a squeeze method. In the flat press method, ink is applied on a surface of a stencil sheet, and then the surface is pressed in a flat condition, so that the ink is extruded through the perforated images of the stencil sheet. In the squeeze method, ink is applied on a surface of a stencil sheet, and then pressed by moving a squeezing plate along the surface, thereby to allow the ink to pass through the perforated images of the stencil sheet. Microscopic observation of these methods shows that the pressurized ink portions press another ink portions disposed below. That is, the ink itself functions as a pressure transmitting substance for extruding the ink.

By the way, as to the ink used in the methods described above, as the fluidity or softness of ink is increased, it permeates further into the printing sheet. This decreases a drawback caused by set-off. In this situation, however, capillarity phenomenon arises between the stencil sheet and the printing sheet, thereby causing an excessive-ink flow and ink bleeding to deteriorate quality of the printed images.

Conversely, ink with low fluidity and softness does not cause capillarity phenomenon easily, thereby improving quality of the printed images. In this situation, however, there arises another problem such that it takes a long time to permit the ink to permeate into the printing sheet after ink-transfer on the printing sheet. Further, as illustrated in FIG. 10 (*a*), when a printing sheet 32 is separated from a stencil sheet 31 upon completion of printing, the two sheets are pulled back to each other by ink 33 with a high viscosity. As an area of a perforated image 31*a* is increased, the phenomenon of the pulling-back by the ink appears more. Consequently, as illustrated in FIG. 10 (*b*), excessive ink is transferred to the printing sheet 32, thereby causing a set-off phenomenon where a back of the sheet is stained when it is stacked after printing.

Accordingly, an object of the present invention is to provide a stencil printing method and a stencil printing machine which overcome the contradictory phenomena previously explained, and can provide stencil printing with an excellent printing quality and less set-off by avoiding excessive ink transfer on a printed sheet or material.

SUMMARY OF THE INVENTION

A stencil printing method as defined in the first aspect of the present invention is for forming an image on a printing material, and comprises preparing ink transfer means having a surface made of an elastically deformable material; applying ink on the surface of the ink transfer means, and pressing the surface of the ink transfer means against stencil sheet with perforations so that a part of the ink transfer means having the ink deforms to enter into the perforations, thereby transferring the ink onto the printing material through the perforations of the stencil sheet to conduct printing on the printing material.

According to a stencil printing method defined in the second aspect of the present invention, in the stencil printing method as defined in the first aspect, at least the surface of the ink transfer means is made of a gel material.

According to a stencil printing method defined in the third aspect of the present invention, in the first aspect, at least the surface of the ink transfer means is made of elastomer.

According to a stencil printing method as defined in the fourth aspect of the present invention, in the first aspect, the ink transfer means is made of a material having extensibility in the surface, and hardness of 3 to 30 degrees on a spring type hardness testing machine Type C specified by JIS K 6301.

According to a stencil printing method as defined in the fifth aspect of the present invention, in the first aspect, the ink has viscosity ranging from 1 to 10 centipoise.

A stencil printing machine as defined in the sixth aspect of the present invention is for forming an image on a printing material by forcing ink to pass through perforations formed in a stencil sheet, and comprises ink transfer means having a surface made of an elastically deformable material, ink apply means situated adjacent to the ink transfer means for applying ink on the surface of the ink transfer means, and pressing means disposed near the ink transfer means for pressing at least the surface of the ink transfer means, at least the surface of the ink transfer means being adapted to be pressed against the stencil sheet to force the surface to enter into the perforations to thereby transfer the ink onto the printing material.

According to a stencil printing machine as defined in the seventh aspect of the present invention, in the sixth aspect, at least the surface of the ink transfer means is made of a gel material.

According to a stencil printing machine as defined in the eighth aspect of the present invention, in the sixth aspect, at least the surface of the ink transfer means is made of elastomer.

According to a stencil printing machine as defined in the ninth aspect of the present invention, in the sixth aspect, the ink transfer means is made of a material having extensibility in the surface, and hardness of 3 to 30 degrees on a spring type hardness testing machine Type C specified by JIS K 6301.

According to a stencil printing machine as defined in the tenth aspect of the present invention, in the sixth aspect, the ink has viscosity ranging from 1 to 10 centipoise.

A stencil printing machine as defined in the eleventh aspect of the present invention is for forming an image on a printing material by forcing ink to pass through perforations formed in a stencil sheet, and comprises a roller having a surface made of an elastically deformable material, ink apply means situated adjacent to the roller for applying ink on the surface of the roller, and pressing means disposed near the roller for pressing at least the surface of the roller, the roller being adapted to be pressed against the stencil sheet to force the surface to enter into the perforations to thereby transfer the ink onto the printing material.

According to a stencil printing machine as defined in the twelfth aspect of the present invention, in the eleventh aspect, at least the surface of the roller is made of a gel material.

According to a stencil printing machine as defined in the thirteenth aspect of the present invention, in the eleventh aspect, at least the surface of the roller is made of elastomer.

According to a stencil printing machine as defined in the fourteenth aspect of the present invention, in the eleventh aspect, the roller is made of a material having extensibility in the surface, and hardness of 3 to 30 degrees on a spring type hardness testing machine Type C specified by JIS K 6301.

A stencil printing machine as defined in the fifteenth aspect of the present invention is for forming an image on a printing material by forcing ink to pass through perforations formed in a stencil sheet, and comprises a flat member having a surface of an elastically deformable material, ink apply means situated adjacent to the flat member for applying ink on the surface of the flat member, and pressing means disposed near the flat member for pressing at least the surface of the flat member, the flat member being adapted to be pressed against the stencil sheet to force the surface to enter into the perforations to thereby transfer the ink onto the printing material.

According to a stencil printing machine as defined in the sixteenth aspect of the present invention, in the fifteenth aspect, at least the surface of the flat member is made of a gel material.

According to a stencil printing machine as defined in the seventeenth aspect of the present invention, in the fifteenth aspect, at least the surface of the flat member is made of elastomer.

According to a stencil printing machine as defined in the eighteenth aspect of the present invention, in the fifteenth aspect, the flat member is made of a material having extensibility in the surface, and hardness of 3 to 30 degrees on a spring type hardness testing machine Type C specified by JIS K 6301.

According to the present invention, ink is applied to the surface of the ink transfer means (such as the roller or the flat member), and then transferred directly to the printing material or to a position near the printing material, after passing through the perforations of the stencil sheet, so that excessive ink application on the printing material is avoided. As a result, quality of the printed images is improved and occurrence of set-off is decreased.

BRIEF DESCRIPTION OF THE DRAWINGS

FIG. 7 (*b*) is a view illustrating a process of stencil printing by the stencil printing machine of the present invention;

FIG. 7 (*c*) is a view illustrating a process of stencil printing by the stencil printing machine of the present invention;

FIG. 7 (*d*) is a view illustrating a process of stencil printing by the stencil printing machine of the present invention;

FIG. 9 (*b*) is an operational view of the second embodiment in the present invention;

FIG. 9 (*c*) is an operational view of the second embodiment in the present invention;

FIG. 10 (*b*) is a view illustrating a condition of a printing material after being printed.

DETAILED DESCRIPTION OF PREFERRED EMBODIMENTS (First Embodiment)

Figure 1:
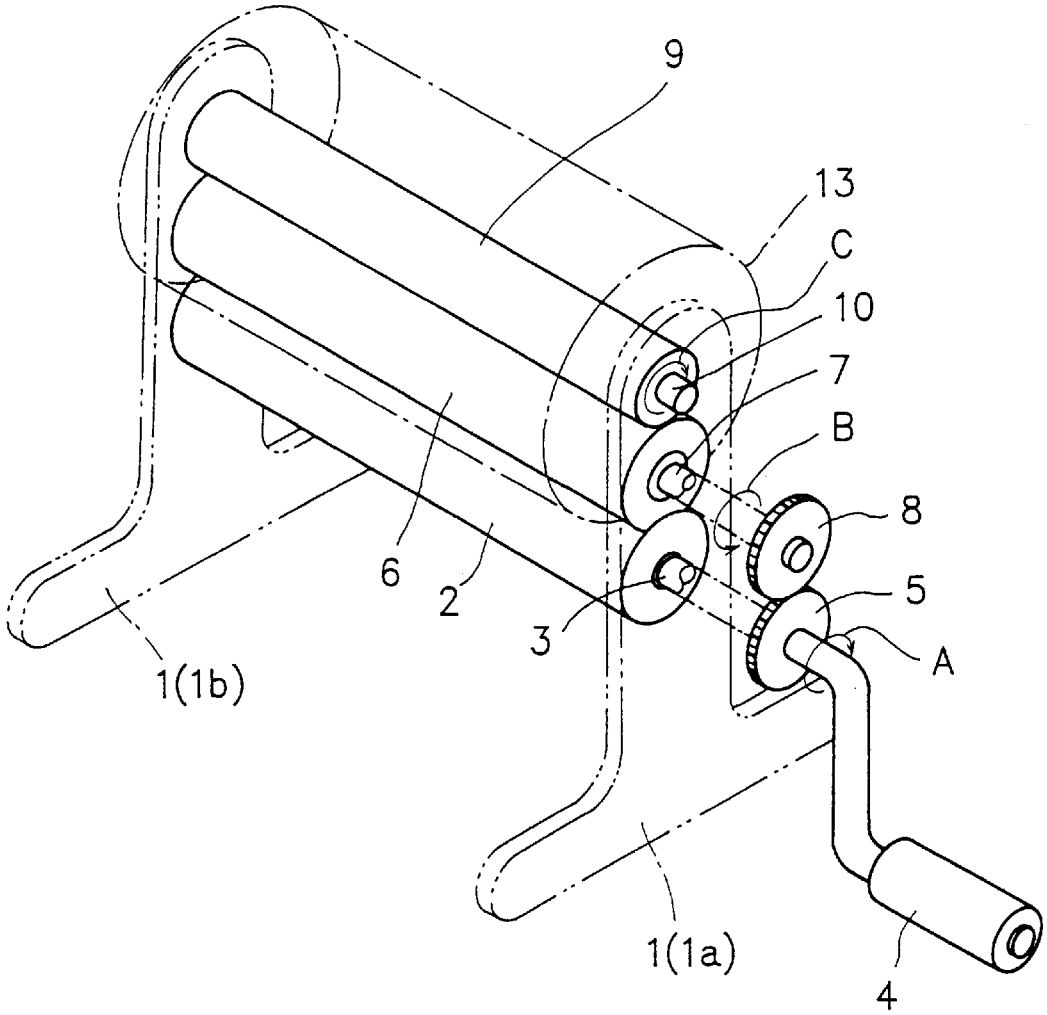
FIG. 1 is a perspective view of a stencil printing machine in one embodiment of the present invention.
Figure 2:
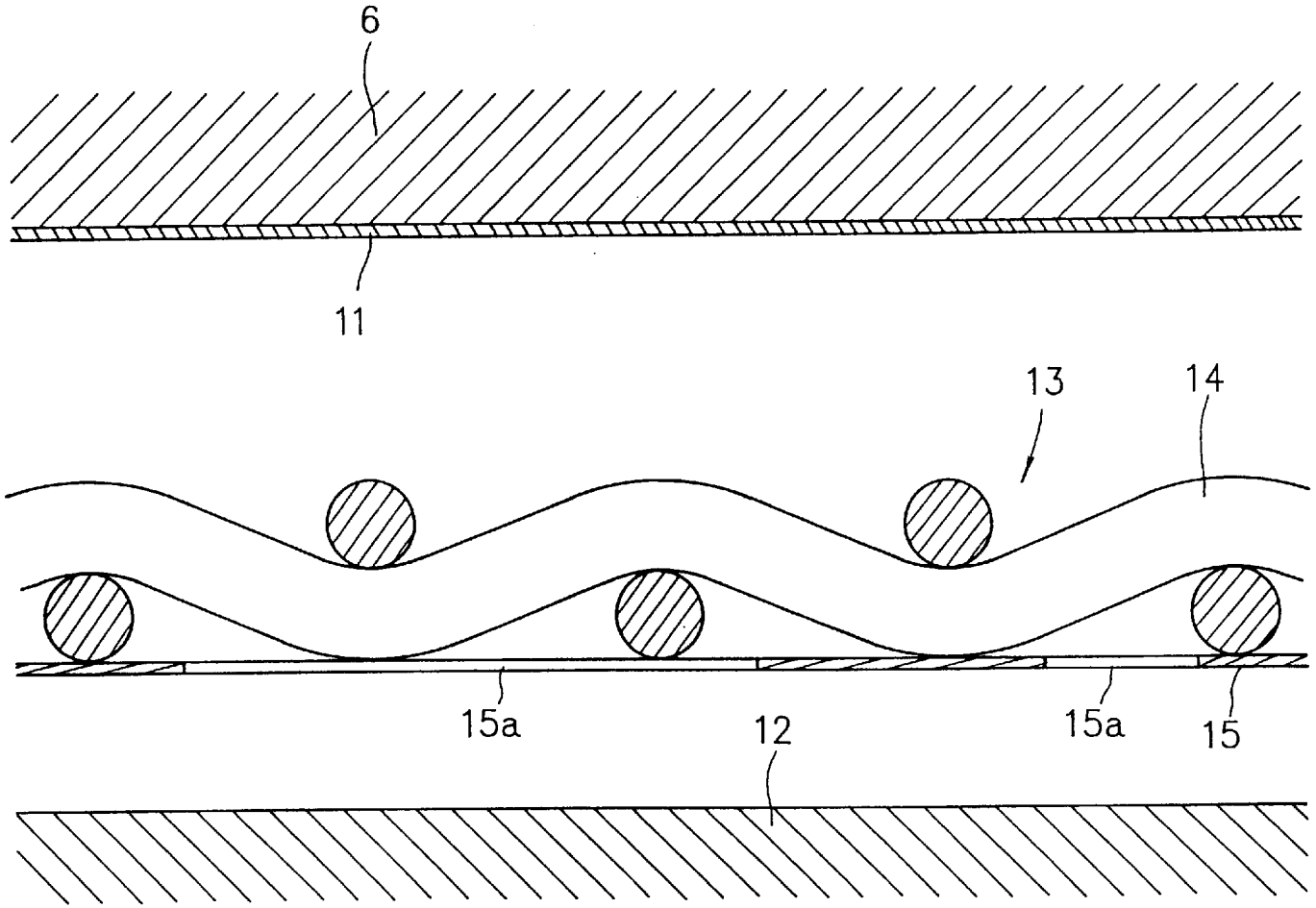
FIG. 2 is a partially enlarged sectional view of the stencil printing machine of FIG. 1.

FIG. 1 is a perspective view illustrating a stencil printing machine in the first embodiment of the present invention. FIG. 2 is a partially enlarged view of the stencil printing machine illustrated in FIG. 1. In FIG. 2, a drive roller and an ink supply roller are omitted, and a driven roller, a stencil sheet and a printing sheet are illustrated separately.

The stencil printing machine of the first embodiment is such that it transfers ink onto a printing material through perforations of the stencil sheet so that a desired image can be formed, and it uses a roller as a conveying means for conveying the stencil sheet and the printing material.

As illustrated in FIG. 1, a cylindrical drive roller 2 is rotatably supported between right and left frames 1(1*a*, 1*b*). One end of a center axis of the drive roller 2 protrudes from the outer face of one frame 1*a*. The drive roller 2 is made of metal for example, aluminum. The drive roller 2 may be made of other material of various kinds such as a same material as that of a driven roller 6 described later and any types of harder or softer material than that of a driven roller 6. The roller 2 may be made of resin or rubber and so on.

An end portion of the center axis 3 of the drive roller 2 protrudes from the frame 1*a*. To the end portion is attached a handle 4 for rotating the drive roller 2 around the center axis thereof. A drive gear 5 is fixed to the center axis 3 protruding from the frame 1*a*, thereby transmitting rotation of the drive roller 2 to the driven roller 6 described later.

As illustrated in FIG. 1, the driven roller 6 as an ink transfer means is rotatably supported between the frames 1*a*, 1*b*. The driven roller 6 is situated above the drive roller 2 to be parallel to the drive roller 2. The driven roller 6 is in a cylindrical shape having the same diameter as that of the drive roller 2 and is rotatable around a center axis thereof. The driven roller 6 is pressed against the circumferential surface of the drive roller 2 by a predetermined pressing force.

A pressing force exerted on the drive roller 2 by the driven roller 6 is determined by adjusting a distance between the center axes 3, 7 relative to diameters of the drive roller 2 and the driven roller 6. An end of a center axis 7 of the driven roller 6 protrudes from the outer face of the one frame 1*a*. A driven gear 8 is fixed to the end of the center axis 7, and meshes with the drive gear 5.

When the drive roller 2 is rotated by operating the handle 4 in a direction illustrated by an arrow "A" in FIG. 1, this rotation of the drive roller 2 transmits to the driven roller 6 through the gears 5, 8 as transmitting means. In this way, the driven roller 6 rotates along with rotation of the drive roller 2 in the same speed as that of the drive roller 2 in a direction illustrated by an arrow B in FIG. 1.

A roller portion of the driven roller 6 is made of a gel material. More specifically, the roller 6 is so constituted that the gel material of a single layer of a several millimeters thick (2 millimeters thick, for example) is formed on the circumferential surface of an aluminium roller by the insert molding method. Otherwise, the roller may be so constituted that the gel material is formed cylindrical by the extrusion molding method and then fitted on a hard roller.

As the gel material in the present embodiment, a nonaqueous high polymer gel can be used. The nonaqueous high polymer gel has a network structure made of a special polymer that holds oil therein. As the nonaqueous high polymer gel there may be mentioned a composite material obtained from a thermal plasticity elastomer and asphalt oil, MNCS (trade name) manufactured by Bridgestone Corporation; also, another composite material obtained by compounding mineral oil into a main component, polyethylene as plasticity elastomer, Cosmo-gel (trade name) manufactured by Cosmo Instrument Co., Ltd.

Further, the roller portion of the driven roller 6 may be composed of plural layers of gel material with different hardness, instead of said single layer of the nonaqueous high polymer gel. In this case, if the hardness of the plural layers of gel material is arranged to increase gradually inward, pressure and driving force can be exerted efficiently on the driven roller by the drive roller, and transmissibility of power is improved.

In the present embodiment, the hardness of the gel layer composing the roller portion of the driven roller 6 is set to the range of 3 to 30° on a spring-type hardness testing machine Type C (ASKER C) specified by JIS K 6301 (established in 1975).

The hardness test specified in JIS K 6301 (established in 1975) will be explained. The standard concerns a physical testing method for vulcanized rubber. This standard specifies a hardness test as one of physical testing methods for vulcanized rubber.

Figure 3:
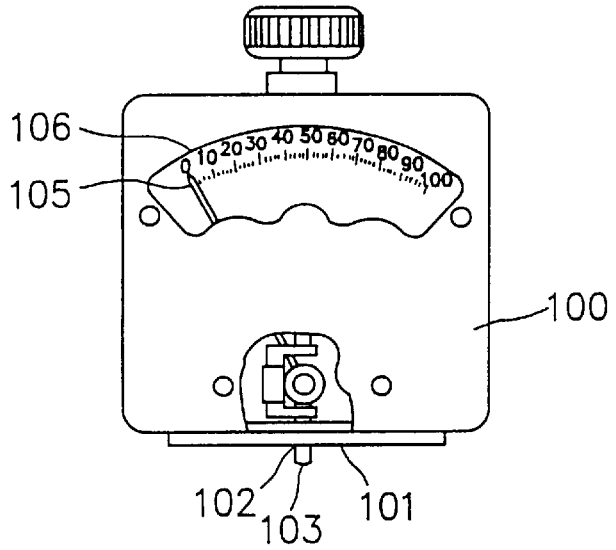
FIG. 3 Prior Art
FIG. 3 is a front view of a spring type hardness testing machine Type C specified by JIS K 6301 (established in 1975)
Figure 4:
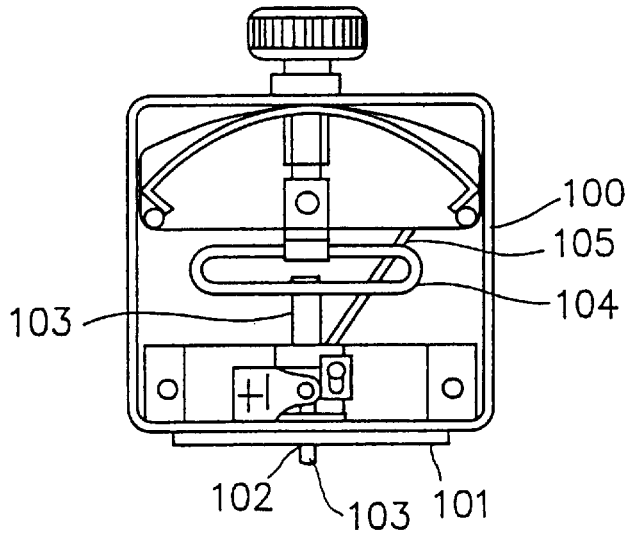
FIG. 4 Prior Art
FIG. 4 is a view illustrating the inner mechanism of the spring type hardness testing machine Type C specified by JIS K 6301 (established in 1975)
Figure 5:
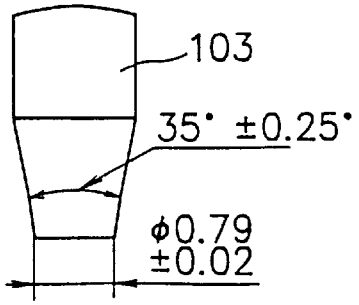
FIG. 5 Prior Art
FIG. 5 is a partially enlarged view of a tip of an indenter needle of the spring type hardness testing machine Type C specified by JIS K 6301 (established in 1975)

The spring-type hardness testing machine Type C which is one of the testing instruments to be used in the hardness test is shown in FIGS. 3 to 5. As illustrated in FIGS. 3 and 4, the testing machine has a casing 100. The underside of the casing 100 serves as a pressure applying face 101 that is pressed against a test piece. A needle hole 102 is formed through the casing 100 nearly at the center of the pressure applying face. In the casing 100 an indenter needle 103 is provided. The tip of the indenter needle 103 is projecting out of the casing 100 through the needle hole 102 in the pressure applying face 101. The rear end of the indenter needle 103 is securely supported by a spring 104 provided inside of the casing 100.

As illustrated in FIG. 5, the indenter needle 103 is a rod having a round cross section, the tip of which is of a truncated cone form having a 35±0.25° tapered surface and a 0.79±0.02 mm diameter. Inside of the casing 100 is mounted a pointer 105 which swings with the axial movement of the indenter needle 103. The casing 100 is provided with a dial scale plate 106 having a hardness scale which is indicated by the pointer 105.

In measurement, the pressure applying face 101 of the spring-type hardness testing machine is pressed against the surface of a test piece to be measured at a load of 5000 gf {49.03N}. The indenter needle 103 projecting out of the casing 100 from the needle hole 102 in the pressure applying face 101 is pushed back into the casing 100 after hitting on the surface of the test piece to be measured. The pointer 105 swings correspondingly to the stroke of the indenter needle 103, thus indicating a value to be obtained on the dial scale plate 106 which indicates the hardness of the test piece.

Figure 6:
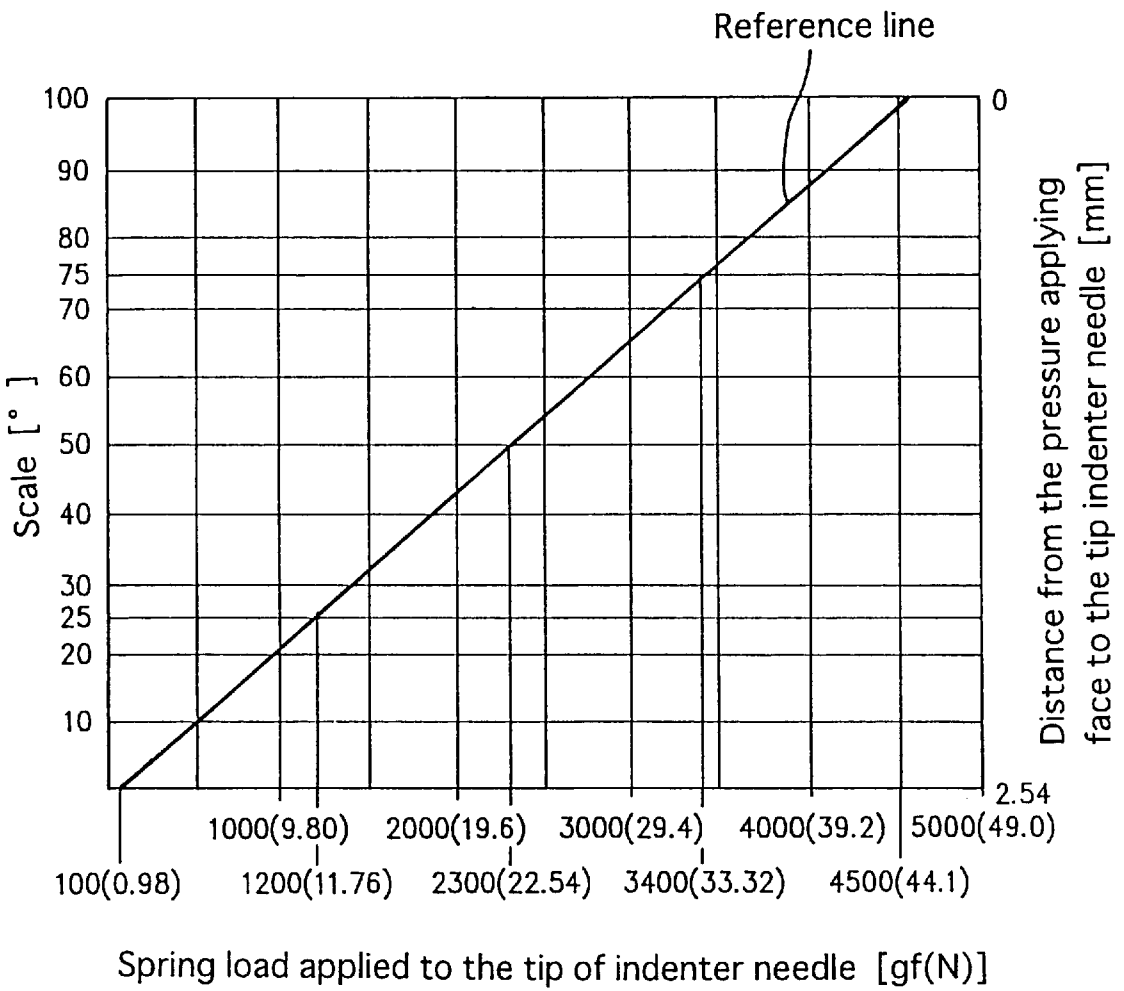
FIG. 6 Prior Art
FIG. 6 is a graph showing a relation, in the spring type hardness testing machine Type C specified by JIS K 6301 (established in 1975), among the load [gf {N}] applied to the tip of the indenter needle by a spring, a hardness scale (degree) indicated on a scale plate, and a distance (mm) between a pressure applying face and the indent needle.
Figure 7A:
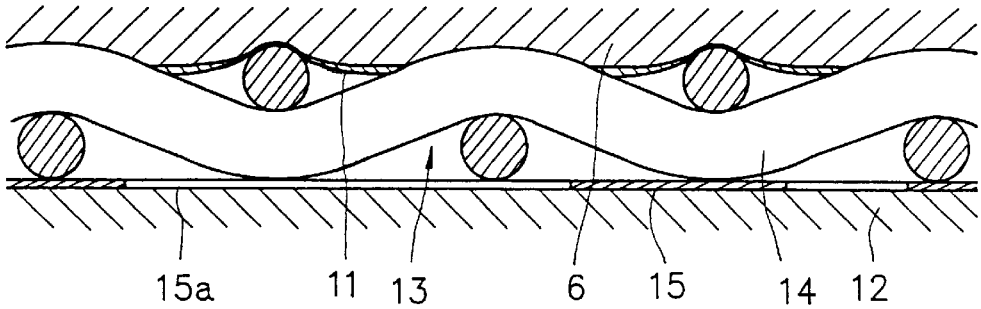
FIG. 7 (*a*) is a view illustrating a process of stencil printing by the stencil printing machine of the present invention.
Figure 7B:
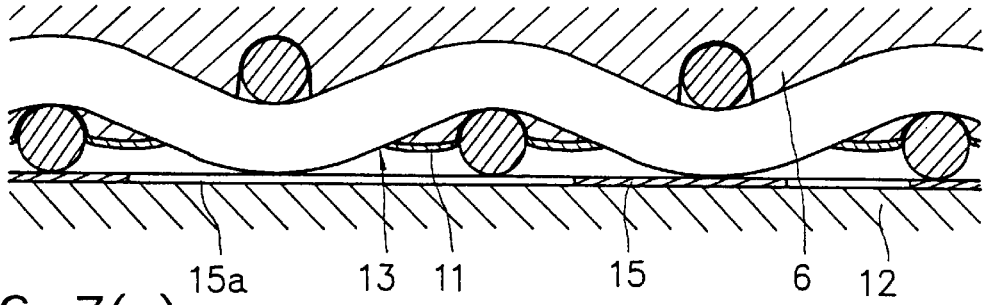
Figure 7C:
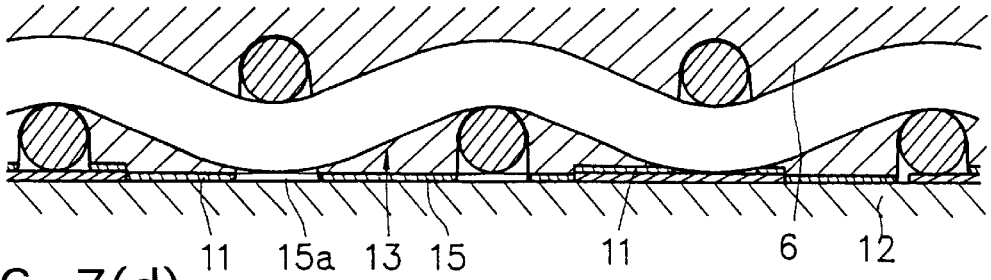
Figure 7D:
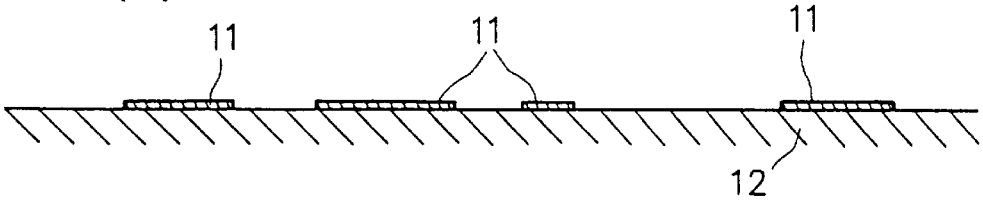

FIG. 6 is a graph showing a relation among load [gf (N)] applied to the tip of the indenter needle 103 by the spring 104, a hardness scale (degree) indicated on the dial scale plate 106, and a distance (mm) between the pressure applying face 101 and the indenter needle 103.

As illustrated in FIG. 1, an ink apply roller 9 as ink apply means is rotatably supported between the frames 1*a*, 1*b*. The ink apply roller 9 is situated above the driven roller 6 to be parallel to the driven roller 6. The ink apply roller 9 is in a cylindrical shape having the smaller diameter than those of the drive roller 2 and the driven roller 6. The ink apply roller 9 is rotatable around a center axis thereof. The ink apply roller 9 is pressed against the circumferential surface of the driven roller 6 at a predetermined pressure.

A pressing force exerted on the driven roller 6 by the ink apply roller 9 is determined by adjusting a distance between the center axes 7, 10 relative to diameters of the driven roller 6 and the ink apply roller 9.

A roller portion of the ink apply roller 9 is made of sponge, for example, which includes independent minute holes. The roller portion uniformly absorbs ink 11 of a desired color. When the driven roller 6 rotates in the direction shown by the arrow B in FIG. 1, the ink apply roller 9 rotates along with the roller 6 in a direction shown by an arrow C in FIG. 1, thereby applying a constant amount of ink to the circumferential surface of the driven roller 6.

As the ink 11 for use, any type of ink can be adopted, regardless of water color type or oil based type, provided that the ink is capable of easily releasing a printing sheet 12 after printing but having adequate viscosity for remaining on the printing sheet 12 thereby developing color thereon. As to such viscosity of the ink 11, a range from 1 to 10 centipoise is preferable. The ink 11 having viscosity within the range can be transferred to the printing sheet 12 to form a layer with a thickness ranging from 1 to 3 $\mu$m after printing.

A stencil sheet 13 for use in the present embodiment is composed of an ink permeable substrate 14 and a heatsensitive resin film 15 adhered to one surface of the substrate 14. The ink permeable substrate 14 has characteristics of allowing the ink to pass through the substrate while holding the ink therein. The resin film 15 has characteristics of melting by heat. On the other surface of the ink permeable substrate 14, there is provided a coating having water repellency or oil repellency such as fluorine or silicon.

As illustrated in FIG. 2, the ink permeable substrate 14 is made of a porous substance consisted of numerous fibers. As the ink permeable substrate 14, there can be mentioned Manila hemp, pulp, sheet paper like Japanese paper made from natural fibers such as mitsumata and paper mulberry, woven and nonwoven fabric made from synthetic fibers such as polyester, nylon, vinylon and acetate, metal fibers and glass fibers. Each of the fibers can be used alone or in admixture with the other one.

High density or large basis-weight of the ink permeable substrate 14 decreases ink-permeability of itself, thereby deteriorating clarity in printing. Conversely, low density or small basis-weight of the substrate 14 deteriorates wear resistance in printing.

Thus, in view of the strength and the permeability of the stencil, the unit weight of the ink permeable substrate 14 is preferably within a range from 1 to 20 g/m$^2$, more preferably within a range from 5 to 15 g/m$^2$. For the same reason, the thickness of the ink permeable substrate 14 is preferably within a range from 5 to 100 $\mu$m and, more preferably, within a range 10 to 50 $\mu$m.

As the resin film 15, there may be mentioned, for example, a polyester film, a polycarbonate film, a polypropylene film, a polyvinyl chloride film, a polyvinyl chloride—vinylidene chloride copolymer film and so on. The thickness of the resin film 15 is usually within a range below 10 $\mu$m and preferably within a range from 0.5 $\mu$m to 6.0 $\mu$m. As illustrated in FIG. 2, the resin film 15 is perforated according to an original image to form perforations 15*a* consisting of many small holes.

Next, a stencil printing method in the constitution thus stated will be explained. FIGS. 7(*a*)–7(*d*) illustrate a stencil printing process in the present embodiment. In FIG. 7, the drive roller 2 and the ink supply roller 9 are omitted.

The stencil sheet 13 is inserted between the drive roller 2 and the driven roller 6 with the resin film 15 side downward. And, then the drive roller 2 is driven to rotate in the direction of the arrow "A" as illustrated in FIG. 1 by operating the handle 4. Thus, the stencil sheet 13 is conveyed from the backward to the forward side in FIG. 1 while being sandwiched between the drive roller 2 and the driven roller 6. Next, when the stencil sheet 13 is conveyed approximately a half-length thereof the conveyance is halted. And, the stencil sheet 13 is formed in a cylindrical shape by fastening the forward end and the rear end thereof over the ink apply roller 9, thereby enclosing the driven roller 6 and the ink apply roller 9. In this state, the handle 4 is operated to rotate the drive roller 2 in the direction "A" in FIG. 1, thereby conveying the stencil sheet 13 so that the leading end portion of the perforations 15*a* of the stencil sheet 13 is positioned to a printing start position.

Next, the printing sheet 12 is inserted between the resin film 15 of the stencil sheet 13 and the driven roller 2. And, when the handle 4 is operated to rotate the drive roller 2 in the direction "A" in FIG. 1, the driven roller 6 rotates in the direction "B" in FIG. 1 along with the rotation of the drive roller 2 while the ink apply roller 9 rotates in the direction "C" in FIG. 1 along with the rotation of the driven roller 6.

In this way, the driven roller 6 rotates along with the rotation of the drive roller 2, while the ink is constantly applied to the circumferential surface of the driven roller 2. The printing sheet 12 is conveyed by the rotation of the drive roller 2 from the backward to the forward side in the perspective view of FIG. 1 while being sandwiched between the drive roller 2 and the driven roller 6. And, as illustrated sequentially in FIGS. 7(*a*)–7(*c*), a part of the surface of the roller portion, which is coated with the ink 11, of driven roller 6 deforms according to the form of the perforation 15*a* with movement of the printing sheet 12.

In the case where the ink permeable substrate 14 of the stencil sheet 13 is somewhat thin, the part of the surface of the driven roller 6 enters into the perforation 15*a* of the stencil sheet 13, thereby coming in direct contact with the printing sheet 12. The ink 11 is thus transferred to the surface of the printing sheet 12 to form a pattern according to the perforation 15*a*, as illustrated in FIG. 7(*d*). Further, if the stencil sheet has oil or water repellent finishing on the ink permeable substance 14 side, less ink remains in a non-perforated area of the ink permeable substance 14, thereby reducing ink consumption.

Contrary to this, the case where the ink permeable substrate 14 of the stencil sheet 13 is somewhat thick, for example the case of Japanese paper, will be considered. When the drive roller 2 is once rotated by operating the handle 4 at the first trial printing, although the roller portion of the driven roller 6 deforms, the ink 11 just reaches only a depth level in the ink permeable substrate 14 near the printing sheet 12.

In this case, after the trial printing is conducted once more or several times, a new printing sheet 12 is inserted between the drive roller 2 and the driven roller 6, and then the drive roller 2 is rotated in the direction "A" in FIG. 1 by operating the handle 4. As a result of the additional trial printing, portions of the ink 11 reaching the depth level in the ink permeable substrate 14 near the sheet 12 are pressed by another portions of the ink 14 disposed above, thereby to transfer to the printing sheet 12. In this operation, since excessive ink is not applied to the driven roller 6, the conventional difficulty in deteriorated quality of the printed images is avoided and the set-off is decreased.

(Second Embodiment)

Figure 8:
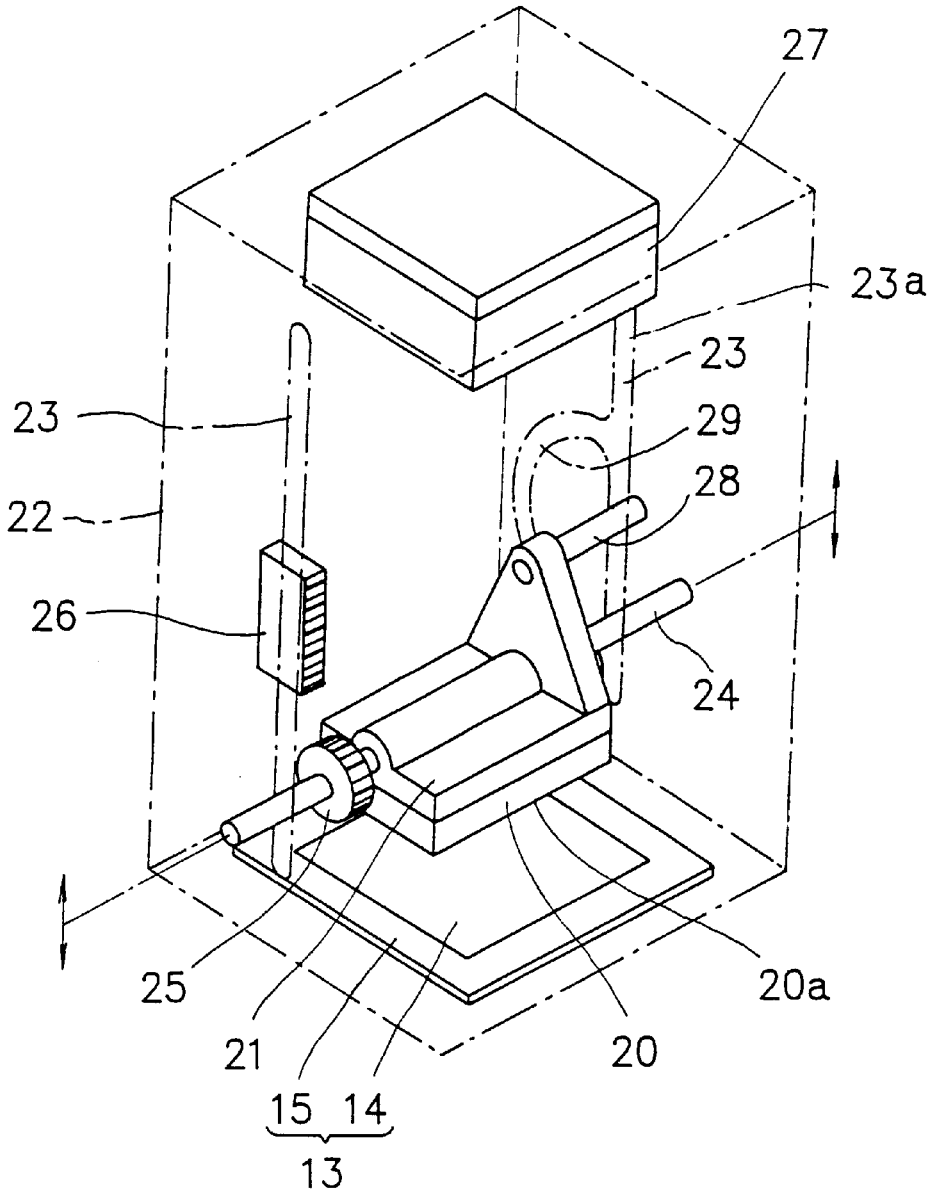
FIG. 8 is a perspective view of a stencil printing machine in the second embodiment of the present invention.
Figure 9A:
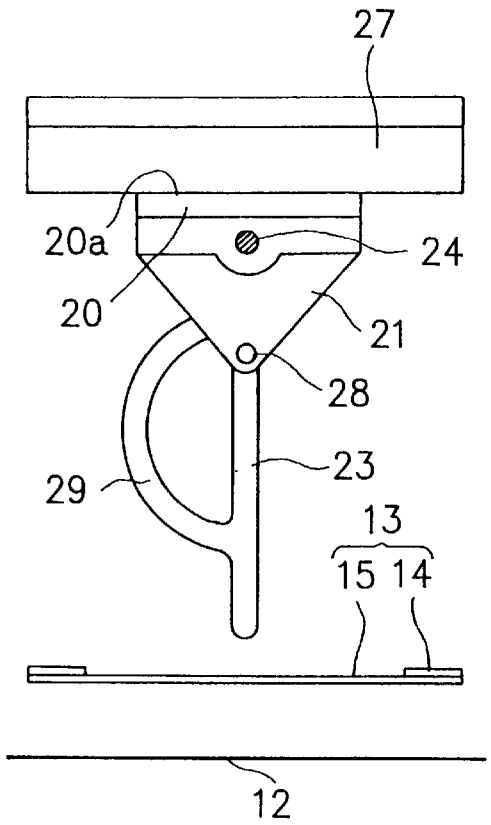
FIG. 9 (*a*) is an operational view of the second embodiment in the present invention.
Figure 9B:
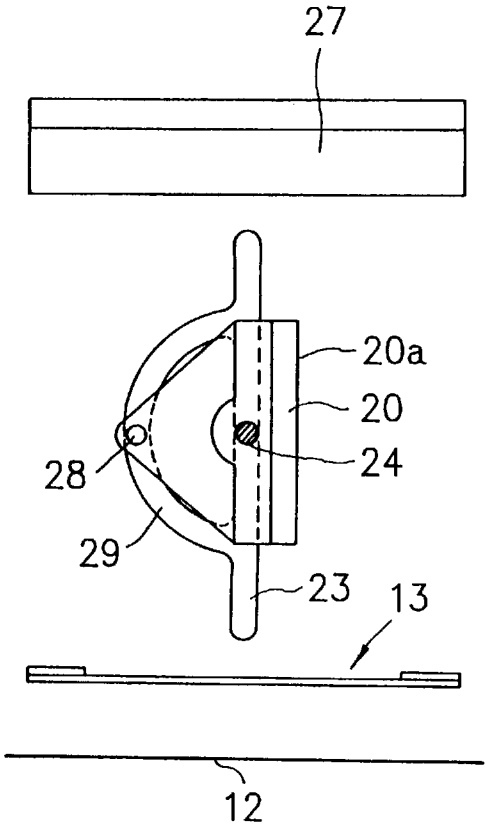
Figure 9C:
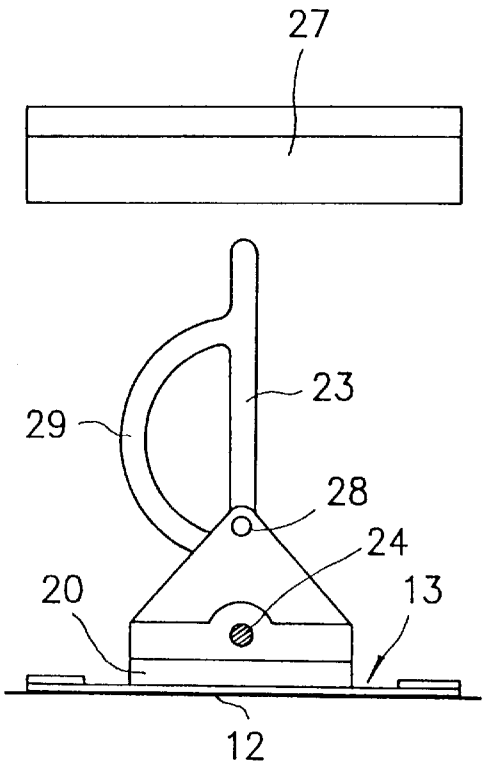
Figure 10A:
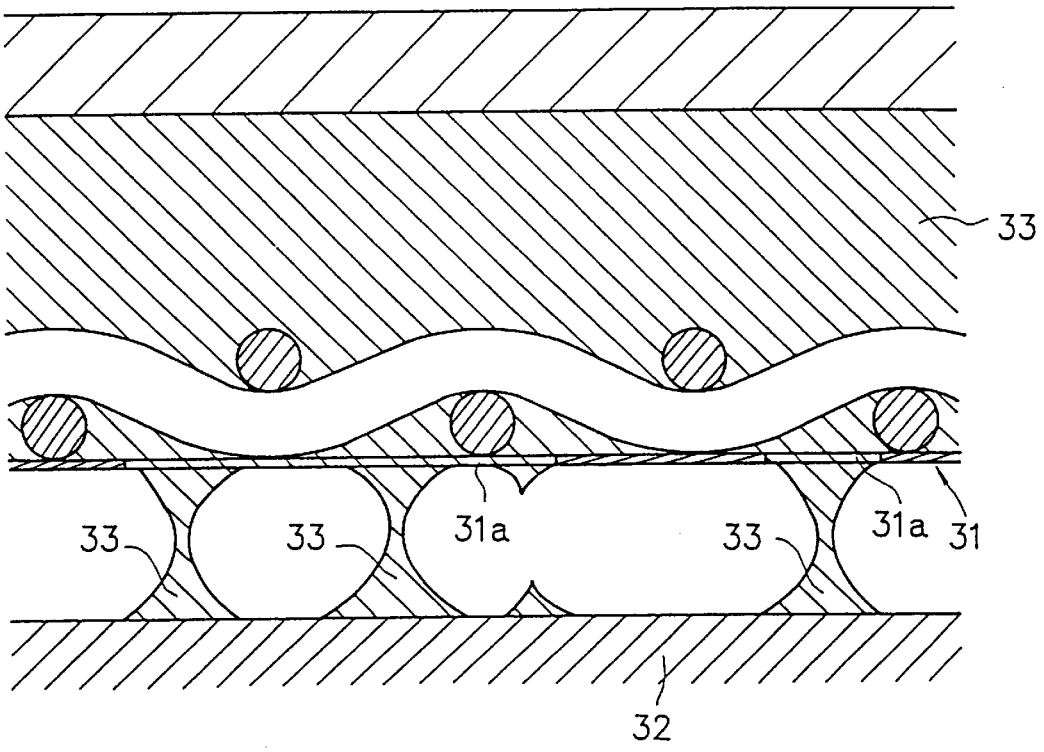
FIG. 10(a) Prior Art
FIG. 10 (*a*) is an explanatory view of the prior stencil printing.
Figure 10B:
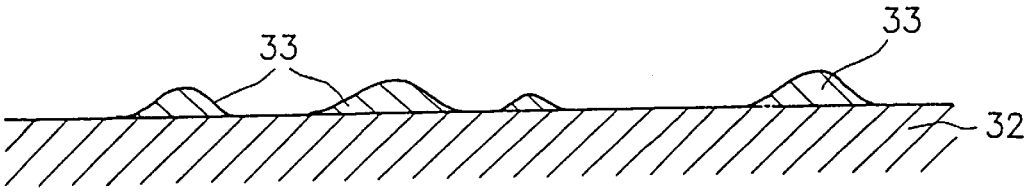
FIG. 10(b) Prior Art

FIG. 8 is a perspective view illustrating a stencil printing machine in the second embodiment of the present invention. FIGS. 9(*a*)–9(*c*) are operational views of the stencil printing machine.

The stencil printing machine in the second embodiment is of a stamp type, in which a flat member 20 is used as ink transfer means.

As illustrated in FIG. 8, the flat member 20 is attached to a flat surface of an L-shaped supporting plate 21. The flat member 20 is made of a gel material such as the nonaqueous high polymer gel similarly to the roller portion of the driven roller 6 in the first embodiment. The supporting plate 21 is rotatably and vertically movably disposed inside a casing 22 with an axis 24 thereof inserted through a pair of vertical grooves 23, 23 formed in the casing 22. The supporting plate 21 is urged upward by urging means such as a non-illustrated spring disposed on the axis 24. A pinion 25 is fitted on one end of the axis 24. The pinion 25 is engaged with a rack 26 fixed to a portion of the casing 22 while moving vertically along the vertical grooves 23, 23.

The casing 22 is in a box-shape having an opening in the bottom surface. In the opening, as illustrated in FIG. 8, the stencil sheet 13 is exchangeably placed parallel to the flat member 20. On the inside surface of the top of the casing 22, an inkpad 27 as ink apply means is disposed parallel to the flat member 20. The inkpad 27 is made of sponge including independent minute holes. The pad uniformly absorbs ink of a desired color.

A guiding arm 28 is attached to a side portion of the supporting plate 21. The arm is directed toward the outside of the casing, and passing through a guiding groove 29 diverging from one groove 23*a* of the vertical grooves 23, 23 while being guided by the groove 23*a*. In this constitution, when the flat member 20 is urged upwardly by elastic force with a transfer surface 20*a* downwards, the flat member 20 attached to the supporting plate 21 is rotated over 180° by engagement of the pinion 25 and the rack 26 with the guiding arm 28 guided by the guiding groove 29. And, then the transfer surface 20*a* is pressed against the inkpad 27 disposed above, thereby absorbing a constant quantity of ink in the inkpad 27.

In the constitution explained above, when a desired image is formed on the printing sheet 12 as a printing material, after the stencil sheet 13 is placed on the printing sheet 12, the flat member 20 attached to the supporting plate 21 is lowered toward the stencil sheet 13.

By the operation, as illustrated sequentially in FIGS. 9(*a*)–9(*c*), the supporting plate 20 is rotated over 180° from the condition in which the transfer surface 20*a* faces the inkpad 27, and then the surface is pressed against the ink permeable substrate 14 of the stencil sheet 13. Consequently, the transfer surface is deformed according to the perforations of the stencil sheet 13. As the result of the deformation, ink is transferred to the printing sheet 12 in a form corresponding to the perforated image.

Then, if the ink permeable substrate 14 of the stencil sheet 13 for use is thick to some extent, printing on the printing sheet 12 should be performed after the trial printing, similarly to the first embodiment.

In this way, according to the second embodiment, ink is not excessively transferred to the printing sheet 12, but adequately supplied there after passing through the perforations, similarly to the first embodiment.

By the way, a material of the ink transfer means, i.e. the drive roller 6 or the flat member 20, is not restricted to the gel material as explained before. Namely, any material can be adopted provided that it has such a surface extensibility that the surface thereof can recover from deformation, and has said hardness of the range of 3 to 30° on the spring-type hardness testing machine Type C specified by JIS K 6301. For example, elastomer such as silicon rubber or urethane rubber can be used.

As ink for use, the one having viscosity ranging from 1 to 10 centipoise is preferable. In the case where ink with high viscosity outside the range is used, the constitution of FIG. 1 may be arranged in such a manner that a blade in a plate or rectangular parallelepiped form is disposed at the corner to contact with the driven roller 6. According to such constitution, excessive ink applied to the driven roller 6 is wiped off along with the rotation of the driven roller 6, so that ink is not excessively transferred to the printing sheet and form there a thin ink-layer in a thickness of 1 to 3 $\mu$m.

Further, a constitution of the stencil printing machine is not restricted to those disclosed in FIGS. 1 and 8. The stencil printing machine should be so constituted that ink transfer means such as a roller or a plate member can deform according to the perforations of the stencil sheet in printing, thereby transferring ink directly to the printing sheet or to a position near the printing sheet through the perforations.

As is apparent from the above description of the present invention, the ink transfer means having ink thereon is pressed against the stencil sheet so as to enter into the perforations formed in the stencil sheet, thereby to transfer the ink directly to the printing sheet or to a position near the printing sheet through the perforations. Thus, excessive ink application on the printing material is avoided; consequently, quality of the printed images is improved and occurrence of set-off is decreased.

What is claimed is:

1. A stencil printing method of forming an image on a printing material, comprising:

preparing ink transfer means having a surface made of an elastically deformable material, said elastically deformable material having extensibility in the surface and hardness of 3 to 30 degrees on a spring type hardness testing machine Type C specified by JIS K 6301, applying ink on said surface of said ink transfer means, and pressing said surface of said ink transfer means against stencil sheet with perforations so that a part of said ink transfer means having said ink deforms to enter into said perforations, thereby transferring said ink onto said printing material through said perforations of said stencil sheet to conduct printing on said printing material.

2. A stencil printing method as defined in claim 1, wherein at least said surface of said ink transfer means is made of a gel material.

3. A stencil printing method as defined in claim 1, wherein at least said surface of said ink transfer means is made of elastomer.

4. A stencil printing method as defined in claim 1, wherein said ink has viscosity ranging from 1 to 10 centipoise.

5. A stencil printing method as defined in claim 1, wherein said surface of said ink transfer means is directly pressed against the stencil sheet with the perforations so that the part of the ink transfer means enters into the perforations and directly contacts the printing material to provide the ink thereon.

6. A stencil printing machine for forming an image on a printing material by forcing ink to pass through perforations formed in a stencil sheet, comprising:

ink transfer means having a surface made of an elastically deformable material, said elastically deformable material having extensibility in the surface and hardness of 3 to 30 degrees on a spring type hardness testing machine Type C specified by JIS K 6301;

ink apply means situated adjacent to said ink transfer means for applying ink on said surface of said ink transfer means, and pressing means disposed near said ink transfer means for pressing at least said surface of said ink transfer means, at least said surface of said ink transfer means being adapted to be pressed against said stencil sheet so that a part of the ink transfer means deforms and enters into said perforations to thereby transfer said ink on the ink transfer means onto said printing material.

7. A stencil printing machine as defined in claim 6, wherein at least said surface of said ink transfer means is made of a gel material.

8. A stencil printing machine as defined in claim 6, wherein at least said surface of said ink transfer means is made of elastomer.

9. A stencil printing machine as defined in claim 6, wherein said ink has viscosity ranging from 1 to 10 centipoise.

10. A stencil printing machine for forming an image on a printing material by forcing ink to pass through perforations formed in a stencil sheet, comprising:

a roller having a surface made of an elastically deformable material, said elastically deformable material having extensibility in the surface and hardness of 3 to 30 degrees on a spring type hardness testing machine Type C specified by JIS K 6301, ink apply means situated adjacent to the roller for applying ink on said surface of said roller, and pressing means disposed near the roller for pressing at least said surface of said roller, said roller being adapted to be pressed against said stencil sheet so that a part of the roller deforms and enters into said perforations to thereby transfer said ink on the roller onto said printing material.

11. A stencil printing machine as defined in claim 10, wherein at least said surface of said roller is made of a gel material.

12. A stencil printing machine as defined in claim 10, wherein at least said surface of said roller is made of elastomer.

13. A combination comprising a stencil sheet with perforations, and a stencil printing machine for forming an image on a printing material by forcing ink to pass through the perforations formed in the stencil sheet, said stencil printing machine including:

ink transfer means having a surface made of an elastically deformable material and directly contacting said stencil sheet, said elastically deformable material having extensibility in the surface and hardness of 3 to 30 degrees on a spring type hardness testing machine Type C specified by JIS K 6301, ink apply means situated adjacent to said ink transfer means for applying ink on said surface of said ink transfer means, and pressing means disposed near said ink transfer means for pressing at least said surface of said ink transfer means through the stencil sheet, at least said surface of the ink transfer means being directly pressed against the stencil sheet so that a part of the ink transfer means deforms and enters into the perforations of the stencil sheet to thereby transfer the ink applied on the ink transfer means directly onto the printing material.

* * * * *